United States Patent [19]

Bunch, III

[11] Patent Number: 5,024,644

[45] **Date of Patent: * Jun. 18, 1991**

[54] CONTINUOUS FORM STATIONERY FOLDING AND CUTTING MACHINE

[75] Inventor: Earnest B. Bunch, III, Glendale, Ariz.

[73] Assignee: B. Bunch Company, Inc., Phoenix, Ariz.

[ * ] Notice: The portion of the term of this patent subsequent to Apr. 10, 2007 has been disclaimed.

[21] Appl. No.: 421,515

[22] Filed: Oct. 13, 1989

Related U.S. Application Data

[63] Continuation-in-part of Ser. No. 279,426, Dec. 2, 1988, Pat. No. 4,915,644.

[51] Int. Cl.[5] ..... B65H 29/66; B65H 35/06; B65H 45/105

[52] U.S. Cl. ..... 493/357; 493/411; 493/414

[58] Field of Search ..... 493/401, 411, 413–415, 493/357, 358, 359, 372

[56] References Cited

U.S. PATENT DOCUMENTS

| | | | |
|---|---|---|---|
| 3,784,188 | 1/1974 | DeLigt | 493/358 |
| 3,912,252 | 10/1975 | Stephens . | |
| 4,508,527 | 4/1985 | Uno et al. | 493/357 |
| 4,522,619 | 6/1985 | Bunch, Jr. | 493/415 |
| 4,623,136 | 11/1986 | Bunch, Jr. | 493/415 |
| 4,702,135 | 10/1987 | Kwasnitza | 493/357 |

*Primary Examiner*—Frederick R. Schmidt
*Assistant Examiner*—Jack Lavinder
*Attorney, Agent, or Firm*—Tod R. Nissle

[57] ABSTRACT

An apparatus for producing continuous form stationery by folding a strip of paper along transverse lines of weakening formed therealong and for cutting the folded continuous form stationery along selected folded transverse lines of weakening.

7 Claims, 6 Drawing Sheets

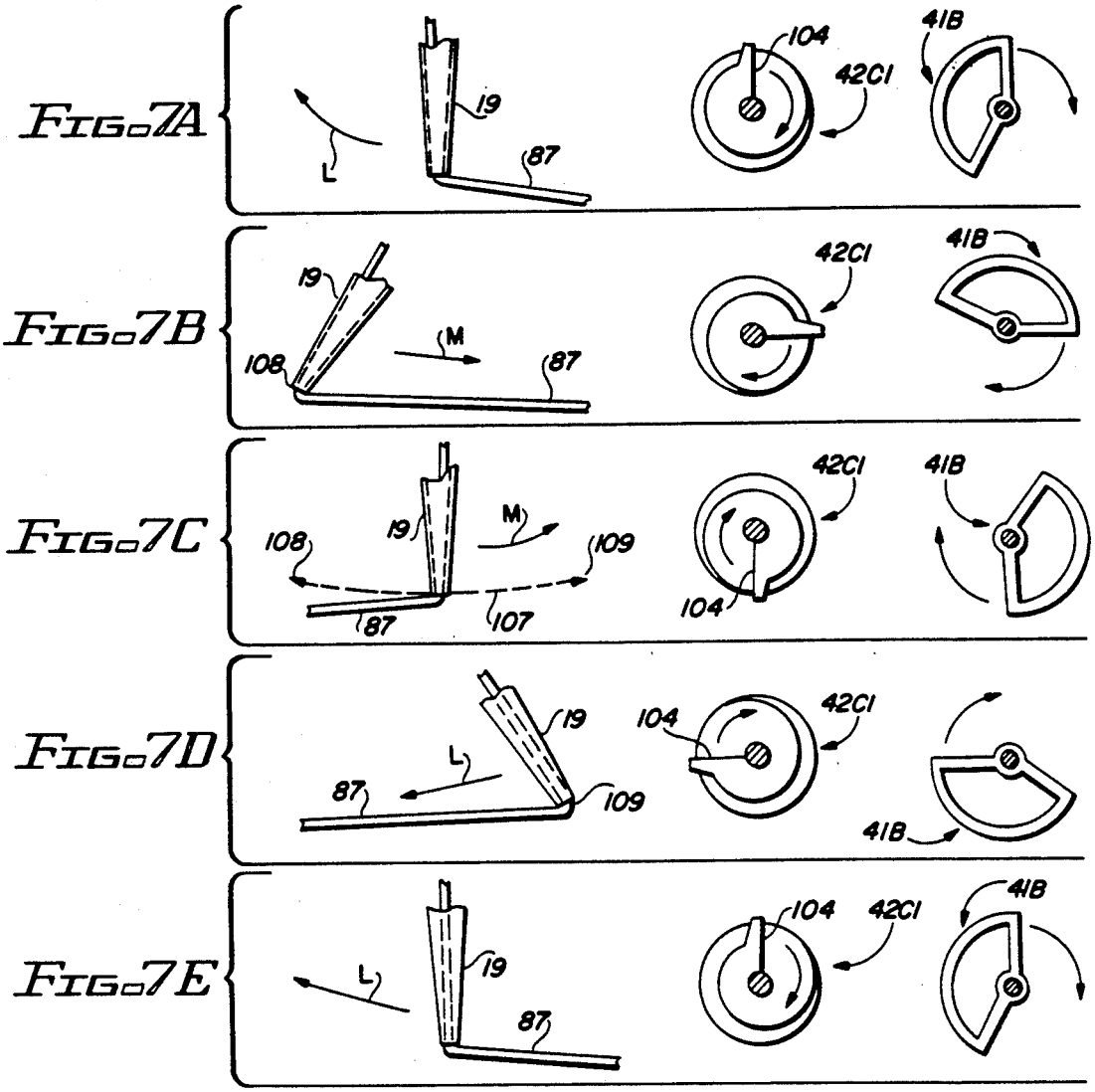
FIG. 7A
L
19
87
104
42C1
41B
FIG. 7B
19
M
108
87
42C1
41B
FIG. 7C
108
19
M
109
87
107
42C1
41B
104
FIG. 7D
19
L
87
109
104
42C1
41B
FIG. 7E
L
19
87
104
42C1
41B
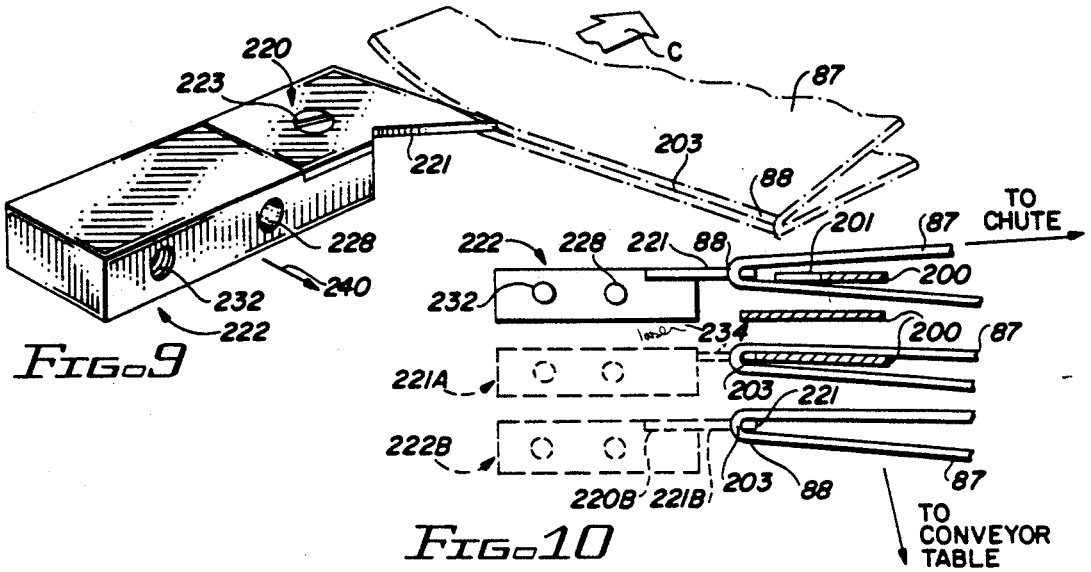
220
223
221
228
232
222
240
FIG. 9
C
87
203
88
TO CHUTE
201
87
222
228
221
88
200
232
234
200
87
221A
203
221
222B
220B
221B
203
88
87
TO CONVEYOR TABLE
FIG. 10

CONTINUOUS FORM STATIONERY FOLDING AND CUTTING MACHINE

This application is a continuation-in-part of application Ser. No. 279,426, now U.S. Pat. No. 4,915,644, issued Apr. 10, 1990for CONTINUOUS FORM STATIONERY FOLDING AND CUTTING MACHINE.

This invention relates to apparatus for producing continuous form stationery by folding a strip of paper along transverse lines of weakening formed therealong and for cutting the folded continuous form stationery along selected folded transverse lines of weakening.

More particularly, the invention concerns an improved stationery folding machine of the type having a dispensing roller which directs a continuous strip of paper into a mechanism which distributes successive lines of weakening formed in the paper in substantially opposite directions and having additional mechanisms for creasing the distributed paper along the lines of weakening to produce continuous form stationery.

In another respect, the invention concerns an improved paper folding machine of the type described which cuts the paper along selected ones of the folded transverse lines of weakening shortly after the transverse lines of weakening have been folded.

Spiral paper folding machines are well known in the art. See, for example, U.S. Pat. No. 4,522,619 to Bunch, issued June 11, 1985 and U.S. Pat. No. 3,912,252 to Stephens, issued Oct. 14, 1975, both of which are incorporated herein by reference. Spiral paper folding machines fold in zip-zag fashion a strip of paper along transverse lines of weakening formed therealong to produce continuous form stationery. One drawback of such folding machines is that they cannot simultaneously fold paper along perforated lines and then cut the folded paper along selected ones of the perforated lines. Instead, it has long been the practice to carry stacks of paper folded in zig-zag fashion to a second machine. The folded paper produced by the spiral paper folder is fed into the second machine. The second machine cuts the paper along selected ones of the folded transverse lines of weakening. Having to utilize a second machine to cut folded paper significantly increases labor costs and other costs associated with processing the paper.

Accordingly, it would be highly desirable to provide an improved paper folding machine which would simultaneously fold a strip of paper along transverse lines of weakening formed therealong and cut the paper along selected ones of the folded transverse lines of weakening.

Therefore, it is a principal object of the invention to produce an improved apparatus for producing continuous form stationery by folding a strip of paper along transverse lines of weakening formed therealong.

Another object of the invention is to produce an improved paper folding machine which simultaneously folds a strip of paper along transverse lines of weakening formed therealong and cuts the paper along selected ones of the folded transverse lines of weakening.

These and other and further and more specific objects and advantages of the invention will be apparent to those skilled in the art from the following detailed description, taken in conjunction with the drawings in which:

FIG. 7 is a schematic chart illustrating the intersynchronous relationship of the chute, spirals and beaters during operation of the spiral paper folding machine;

FIG. 9 is a perspective view illustrating folded transverse line of weakening being cut during operation of the severing apparatus of the invention: and, FIG. 10 is a diagrammatic side view of a spiral, of the paper, and of the cutting blade of FIG. 8 further illustrating the operation of the apparatus of the invention.

Briefly, in accordance with our invention, we provide an improved apparatus for producing continuous form stationery by folding a strip of paper along transverse lines of weakening formed therein. The apparatus includes a frame; oscillating guide means mounted on the frame for alternately distributing the successive lines of weakening in the paper in substantially opposite directions; means for feeding the paper into the guide means at a predetermined speed; folding means carried on the frame and operatively associated with the oscillating guide means for urging the paper distributed by the guide means into a folded condition, the folding means including first and second spaced apart sets of spirals shaped and dimensioned and rotatably driven to receive paper from the oscillating guide means to fold the paper along the transverse lines of weakening. The guide means, feeding means and folding means move in synchronous relationship during the operation of the apparatus. The improvement comprises means for severing the folded paper along selected ones of the folded transverse lines of weakening. The severing means includes cutting means mounted for movement between at least two operative positions, a first operative position to one side of transverse lines of weakening urged into folded condition by one of the sets in the pair consisting of the first and second sets of spirals, and a second operative position to the other side of the folded transverse lines of weakening urged into folded condition by the one of the sets in the pair consisting of the first and second sets of spirals; and, means for moving the cutting means from the first operative position to the second operative position at a selected time to cut one of the folded transverse lines of weakening urged into folded condition by the one of the sets in the pair consisting of the first and second sets of spirals. The one of the folded transverse lines of weakening interconnects paper extending between the first and second sets of spirals.

Figure 1:
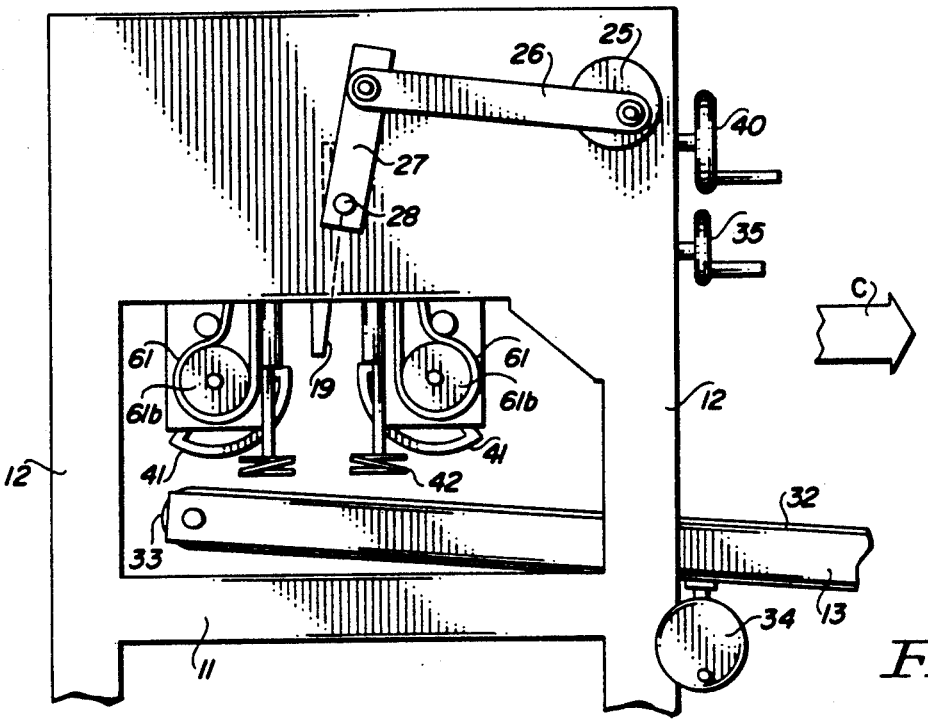
FIG. 1 is a left side elevational view of a conventional spiral paper folding machine.
Figure 2:
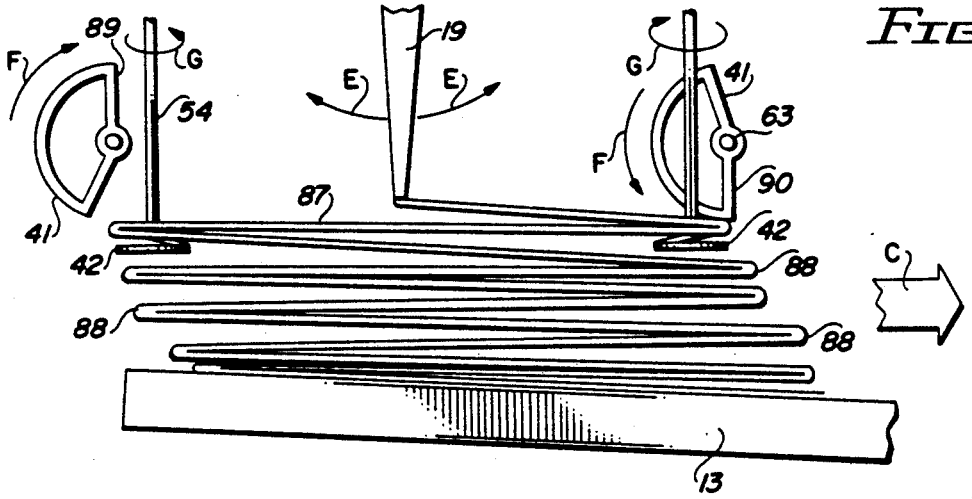
FIG. 2 is a schematic view of the spiral paper folding machine of FIG. 1 showing the interrelationship between the paper folding mechanisms therein.

Turning now to the drawings, which depict the presently preferred embodiments of the invention for the purpose of illustrating the practice thereof and not by way of limitation of the scope of the invention, and in which reference characters identify corresponding elements like throughout the several views, FIGS. 1 and 2 illustrate the arrangement of the elements in a conventional spiral general paper folding machine. A frame consisting of horizontal members 11 and vertical members 12 supports conveyor table 13 and various paper folding mechanisms. A continuous strip of paper or other material is directed by a dispensing roller (not visible) into guide means or chute 19. Transverse lines of weakening along paper entering chute 19 are distributed in substantially opposite directions as chute 19 oscillates. The paper distributed by chute 19 is compressed and folded by beaters 41 and spirals 42. Continuous moving belts carried by roller 33 carry the folded paper away from the folding mechanisms in the direction of arrow C. Arm 27, shaft 28, link 26, and gear 25 transmit motive power to chute 19. Spirals 42 rotate in the directions indicated by arrows G. Beaters 41 rotate in the directions indicated by arrows F. Belts 61 and rollers **61*b* transmit motive power to beaters 41. Spirals 42 and beaters 41 form folds 88 in paper 87. Chute 19 oscillates in the directions indicated by arrows E. The slope of table 13 is adjusted by turning handle 34. Handle 35 is turned to adjust the position of the spirals, beaters and paper stops (not visible in FIGS. 1 and 2). Handle 40 is utilized to adjust a differential mechanism (not visible in FIGS. 1 and 2). Beaters 41 are positioned along shafts 63. Beaters 41 includes leading edges 89 and 90. The spiral paper folding machine illustrated in FIGS. 1 and 2 corresponds to the machine described in U.S. Pat. No. 4,522,619. The operation of spiral folding machines is well understood in the art. To facilitate, however, the understanding of how the spiral folding machine of FIGS. 1 and 2** operates, like reference characters here and in U.S. Pat. No. 4,522,619 identify corresponding elements.

Figure 3:
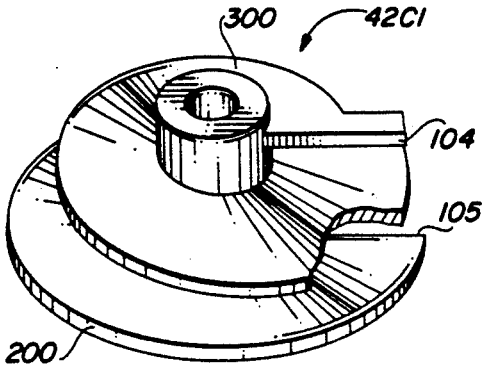
FIG. 3 is a perspective view of a spiral utilized in the apparatus of the invention.
Figure 4:
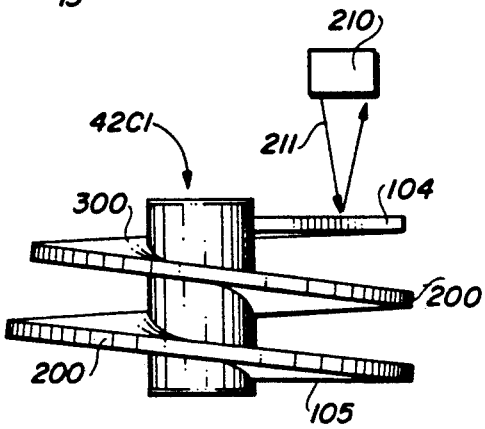
FIG. 4 is a side view further illustrating the spiral of FIG. 3.

FIGS. 3 and 4 illustrate a spiral 42C1 utilized in one embodiment of the invention. Spiral 42C1 includes leading edge 104 and trailing edge 105. Helical spiral 200 begins at edge 104 and spirals downwardly to terminate at edge 105.

Figure 5:
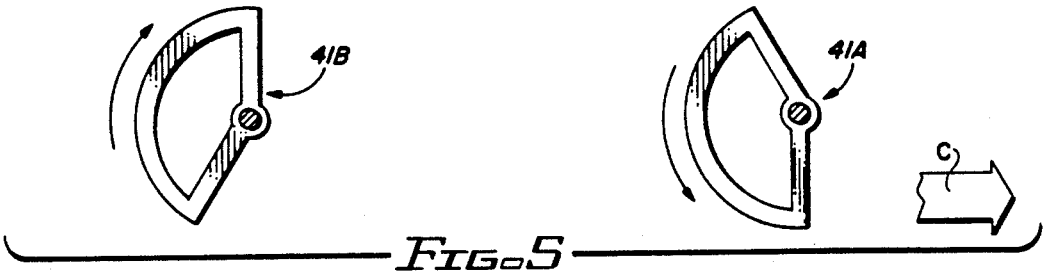
FIG. 5 is a side view of the front and rear beaters of the spiral paper folding machine when the spirals are in the orientation illustrated in FIG. 6.
Figure 6:
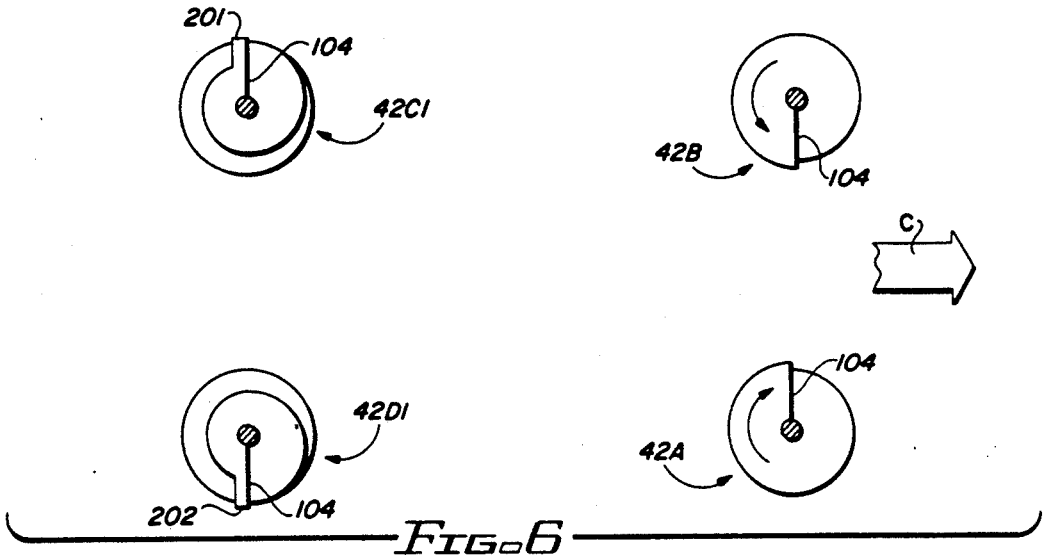
FIG. 6 is a top view of the front and rear spiral sets of the paper folding machine of the invention illustrating the orientation of the spirals when the beaters are in the positions shown in FIG. 5.

In FIG. 10 beaters 41B and 41C are shown in the positions they can occupy when the spirals 42A, 42B, 42C1, and 42D1 are in the positions illustrated in FIGS. 6. As is illustrated in FIG. 6, there are typically two sets of spirals, a "rear" set 42A, 42B, and a "front" set 42C1, 42D1. In conventional spiral folding machines the front set of spirals usually do not include fingers 201, 202 and instead are similar in construction to the rear spirals 42A, 42B. In both FIGS. 5 and 6 the general movement of folded paper down conveyor table 13 is indicated by arrow C.

The beater 41A in FIG. 5 corresponds to the right hand beater in FIG. 1. Beater 41B in FIG. 5 corresponds to the left hand beater in FIG. 1. Spiral 42A in FIG. 6 corresponds to the right hand spiral in FIG. 1. Spiral 42D1 in FIG. 6 would take the place of the conventional left hand spiral in FIG. 1.

Figure 8:
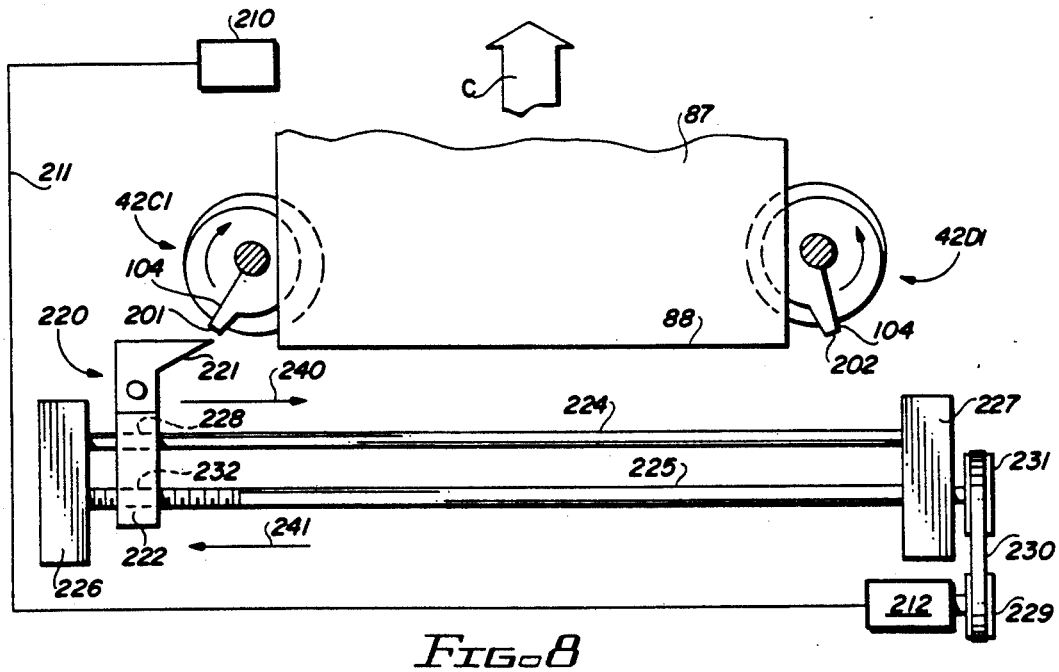
FIG. 8 is a top view illustrating the interrelationship between the spirals and the severing apparatus of the invention.

A sensor is illustrated in FIG. 4 positioned above spiral 42C1. Sensor 210 is a conventional opto-sensor which measures the time required to bounce a beam of light 211 off of the upper surface area of spiral 42C1 which is directly beneath sensor 210. Sensor 210 is fixed. Spiral 42C1 rotates during operation of the spiral folding machine. Consequently, sensor 210 can be programmed to know when leading edge 104 is passing directly beneath sensor 210. When sensor 210 detects edge 104 immediately beneath sensor 210, sensor 210 sends a signal to a designated receiver. In FIG. 8 the signal from sensor 210 is sent over line 211 to motor 212.

In each of FIGS. 7A to 7E, the position of oscillating guide means or chute 19 and of spiral 42C1 and a beater 41B at a particular instant is pictured to further illustrate the synchronous relation therebetween. Since each beater and spiral completes a revolution whenever the chute 19 complete two swings through its arc 107, the position of the other beaters and spirals not shown in FIGS. 7A to 7E can be readily determined with reference to FIGS. 5 and 6. At its farthest points of travel 108, 109 the mouth of the chute 19 normally points at either the rear spirals 42A, 42B or the front spirals 42C1, 42D1, respectively. When the spiral 42C1 and beater 41B are in the reference orientation position shown in FIG. 7A, the chute 19 is in a corresponding selected orientation position in the middle portion of the swing of chute 19 through its arc 107 in the direction of arrow L. When the spiral 42C1 and beater 41B are in the reference orientation position shown in FIG. 7B, the chute 19 is at one of the furthest points 108 of its travel and the mouth of chute 19 points toward spirals 42C1 and 42D1. When the spiral 42C1 and beater 41B are in the reference orientation position shown in FIG. 7C, the chute 19 is again in the middle portion of its arc of swing 107 and is moving in the direction of arrow M. When the spiral 42C1 and beater 41B are in the reference orientation position illustrated in FIG. 7D, the chute is in a selected orientation position corresponding to its furthest point of travel 109 toward spirals 42A and 42B (FIG. 6) and is beginning to reverse direction to move in the direction of arrow L. When the spiral 42C1 and beater 41B are in the reference position of FIG. 7E, the chute 19 is in a selected orientation position in the middle of its arc of swing 107 and is moving in the direction of arrow L away from spiral 42A and toward spirals 42C1 and 42D1. The position of spiral 42C1 in FIG. 6 corresponds to the position of spiral 42C1 in FIG. 7A. Likewise, the position of beater 41B in FIG. 5 corresponds to the position of beater 41B in FIG. 7A. In FIG. 8, the position of spiral 42C1 is intermediate the positions of spiral 42C1 in FIGS. 7D and 7E.

FIG. 8 illustrates severing apparatus utilized to cut selected folds 88 produced by spirals 42C1 and 42D1. The severing apparatus includes cutting means comprised of blade 220 provided with knife edge 221. Blade 220 is attached to base 222 with screw 223 (FIG. 9). Each end of cylindrical rod 224 is fixedly secured in one of frame members 226, 227. Members 226 and 227 can each be attached to a member 12 or can be mounted independently of the spiral folded frame illustrated in FIG. 1. Rod 224 slidably extends through cylindrical aperture 228 formed through base 22. Each end of externally threaded cylindrical rod 225 is journalled in one of frame members 226, 227 such the ends of rod 225 can, without being laterally displaced, in direction 240 or 241, rotate in members 226, 227 when motor 212 turns pulley to turn continuous belt 230 and pulley 231 fixedly attached to one end of threaded rod 225. Rod 225 rotatably extends through internally threaded aperture 232 formed through base 222.

In operation, sensor 210 detects when leading edge 104 of spiral 42C1 is at the position illustrated in FIG. 8 and sends a signal through line 211 to activate motor 212. Motor 212 turns pulley 230 in a selected direction which in turn causes externally threaded rod 225 to rotate in a selected direction. When rod 225 rotates, base 222 and blade 220 move in the direction of arrow 240 from one side of paper 87 to the other side of paper 87. When the blade or cutting means 220 is moved from one side of fold 88 to the other side of fold 88 in FIG. 8, cutting edge 221 severs the fold 88 in the manner illustrated in FIG. 9. Fold 88 is cut along its entire length.

The position of blade 220, spiral 42C1, and fold 88 in FIG. 8 is further illustrated in the side view of FIG. 10. In FIG. 10 cutting edge 221 is shown just prior to motor 212 being activated to turn continuous belt 230 to move base 222 in the direction of arrow 240. After base 222 has moved in the direction of arrow 240 from the left side (in FIG. 8) of fold 88 to the right side of fold 88 and has cut fold 88 along its entire length, motor 212 can be reversed to reverse the direction of rotation of threaded rod 225 and move base 222 in the direction of arrow 241 back to its base or "start" position illustrated in FIG. 8.

In FIG. 8 sensor 210 detects when leading edge 104 of spiral 42C1 is in a selected position. When the selected position of edge 104 is detected motor 212 is triggered to move blade 220 in the direction of arrow 240 to cut fold 88 along the line of perforation 203 at the fold. The purpose of sensor 210 is to determine when a fold 88 has been formed and is in the proper position relative to blade 220 to be cut. The spirals, chute, beaters of the folding machine run in synchronous relationship. Folds 88 are formed and move downwardly and outwardly from the spirals in a predictable manner when the chute, spirals, beaters, and conveyor table have selected speeds or positions with respect to one another. Accordingly, sensor 210 could just as easily monitor the chute, another point on another spiral, a point on a beater and—when sensor 210 determined the chute, other spiral, or other beater was in the proper position—then trigger motor 212. As would appreciated by those of skill in the art, any of a multitude of points on the drive train and folding mechanism could be monitored by sensor 210 to trigger or activate motor 212 when a fold was 88 was made in proper position to be cut by edge 221. Further, it is not necessary that a sensor 210 be used. When a spiral paper folding machine is being operated at a slow speed the operator can visually determine when a fold 88 has been prepared and is in proper position to be cut by edge 221. Once the operator visually determines that a fold 88 is in position to be cut, the operator manually turns on or otherwise activates motor 212 to cause base 222 to move in the direction of arrow 240 and cut fold 88 in FIG. 8. In fact, at slow operating speeds, a motor 212 need not be used. The operator can, as long as rod 225 can freely rotate in frame members 226 and 227, manually pull base 222 in the direction arrow 240.

In FIG. 8 blade 220 is positioned to cut the top most fold 88 on spirals 42C1 and 42D1. In other words, as shown in FIG. 10, the sheet of paper 87 visible in FIG. 8 leads to the mouth of the chute 19. The cutting means of the invention can be vertically positioned as desired to cut any selected fold produced by spirals 42C1 and 42D1 (or, of course, by spirals 42A and 42B). As shown in FIG. 2 a "stack" or series of folds 88 at various vertical positions is continually produced by the spirals during operation of the apparatus of the invention. This stack of folded paper moves downwardly away from the spirals and moves down the conveyor table in the direction of arrow C. The cutting means 220 can be fixed in an appropriate vertical position or elevation to cut folds 88 at any selected vertical distance above the ground or above some other reference point. This is illustrated in FIG. 10. In FIG. 10 a base 222B and blade 221B vertical position to cut a fold 88 which has dropped below the helical flight 200. Note that the transverse line of perforation or weakening in the fold is indicated by reference character 203. Similarly, in FIG. 10 a base 222A is shown in dashed outline as including a means (not visible) for generating cutting means comprising a laser beam 234 which burns and severs a fold 88 along a line of perforation 203 when base 222 moves along rods 224 and 225 in the direction of arrow 240.

Arms 201, 202 can be resilient or rigid. Arms 201, 202 are preferably somewhat resilient so that they can resiliently give in the event they are contacted by blade 221. The diameter of upper portion 300 of helical flight 200 is less than the diameter of the lower portion so that the likelihood of blade 220 striking spirals 42C1 and 42D1 is reduced when blade 220 travels in the direction of arrow 240 to cut a fold 88. If blade 220 is vertically positioned to cut a fold 88 which has fallen beneath spirals 42C1 and 42D1, there is no danger of blade 220 striking a spiral. When arms 201 and 202 are in the positions illustrated in FIG. 8, they are "clear" of fold 88 and will not be contacted by blade 220 when it is moved in the direction of arrow 240.

In accordance with the invention, cutting means can be positioned to cut any of the folds 88 illustrated in FIGS. 2 which are supported by the spirals or are generally intermediate the spirals and conveyor table 13. Each of the folds 88 illustrated in FIG. 2 is a long a transverse line of weakening which interconnects paper 87 extending between the front and rear spirals i.e., which interconnects paper extending between the right hand spiral 42 in FIG. 2 and the left hand spiral 42 in FIG. 2. For purposes of this Specification and the Claims a length of paper extending from a fold 88 shall be deemed to extend between the front and rear sets of spirals if at least a portion of the length of the paper extends to a position within an envelope defined by a pair of spaced apart parallel planes each passing through the rotatable shafts 54 carrying spirals 42. In FIG. 2 each of these planes would be perpendicular to the plane of the sheet of paper of the drawings and would pass through one of the vertical shafts 54 supporting spirals 42. Consequently, each fold 88 in FIG. 2 would, by definition, interconnect paper extending between the front and rear sets of spirals.

In addition to blade 220 and laser beam 234, the cutting means utilized in the invention can comprise a stream of compressed air, a thin heated wire, or any other desired means of severing paper along a fold 88. When fold 88 is cut, the cut is ordinarily preferably made along the transverse line of weakening in the fold. At times, however, the cut line will be offset or spaced a small distance away from the transverse line of weakening. Consequently, as utilized herein, a cut along the transverse line of weakening will be understood to include cuts made directly along or within about one quarter inch of the line of weakening.

Blade 220 is generally positioned inside a fold 88. Laser beam 234 is positioned outside a fold 88. Consequently, the cutting means can, as desired, be positioned inside or outside of a fold 88.

In FIGS. 8 and 10 base 222 moves in a direction of travel parallel to a fold 88. It is not necessary that the means for moving cutting means along a fold 88 move parallel to the fold. For instance, when a beam from a search light contacts or illuminates a wall, the end of the beam is moved along the wall by pivoting the search light housing about a fixed pivot point to sweep the beam through an arc. The pendulum of a clock and the chute 19 of a spiral folder also oscillate or sweep through an arc. Means used in the invention to move cutting means along a fold 88 can also, in whole or in part, sweep through an arc or otherwise move in a non-linear fashion or move in a direction of travel not parallel to fold 88. For example, if a laser beam instead of a light beam is emitted from a search light housing, the search light housing can be pivoted to move the laser beam along a fold 88 to cut the fold.

In the paper folding apparatus illustrated in U.S. Pat. No. 4,547,184 to Bunch, Jr., a chute alternately dispenses lines of weakening in a strip of stationery in opposite lateral direction of travel. Stationery distributed by the chute is received between a pair of opposed endless belt units. The endless belt unites fold stationery dispensed by the chute and form a zig-zag stack of stationery between the belt units. The pair of opposed belt units contacts the outer parallel edges of the stationery and gradually carries the dispensed stationery away from the chute. In another embodiment of my invention, illustrated in FIGS. 11 to 14, I have incorporated the cutting mechanism of FIGS. 8 and 9 with the folding apparatus of U.S. Pat. No. 4,547,184 to Bunch, Jr.

Figure 11:
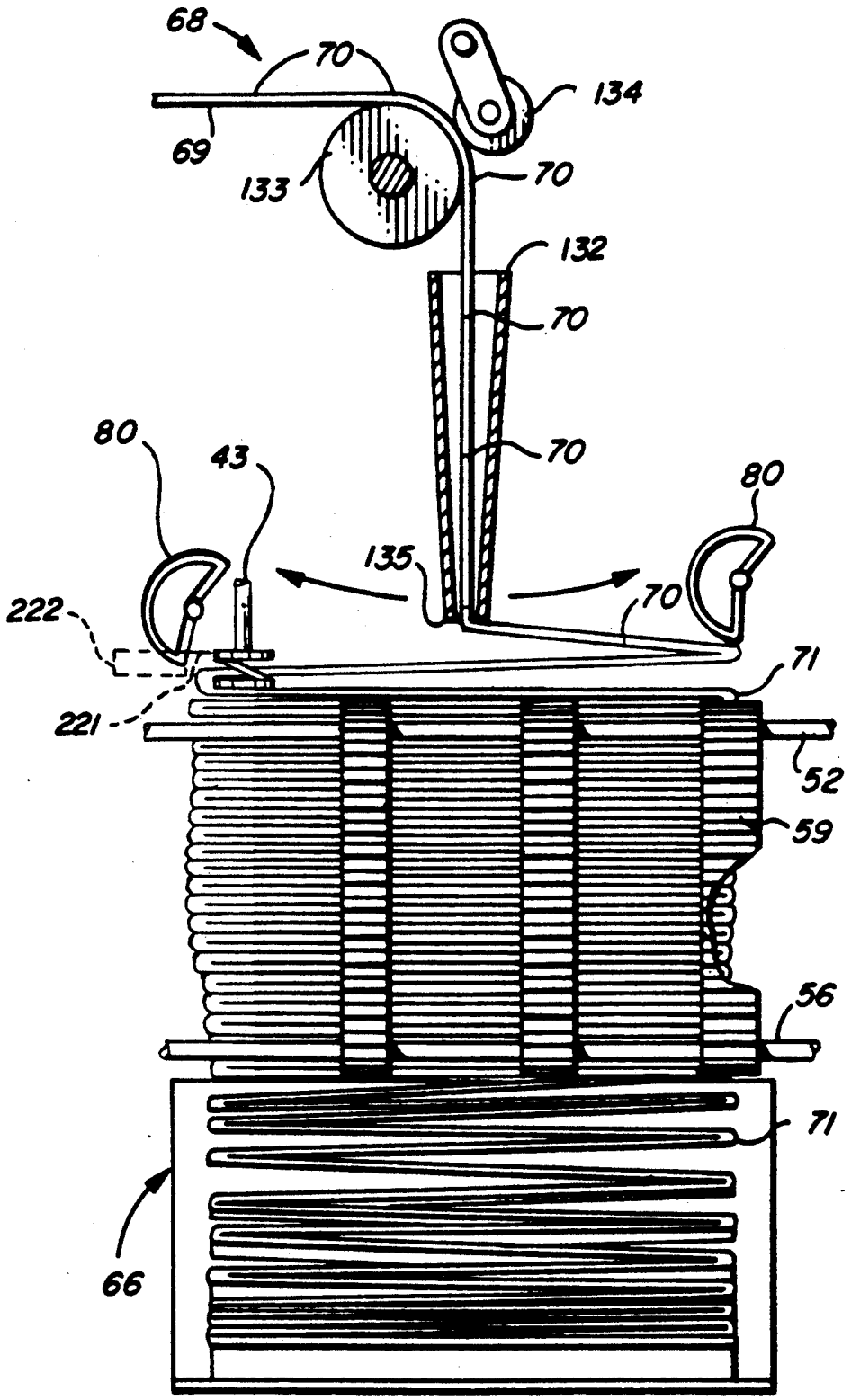
FIGS. 11–14 shows a second embodiment of the zig-zag folding apparatus.
Figure 12:
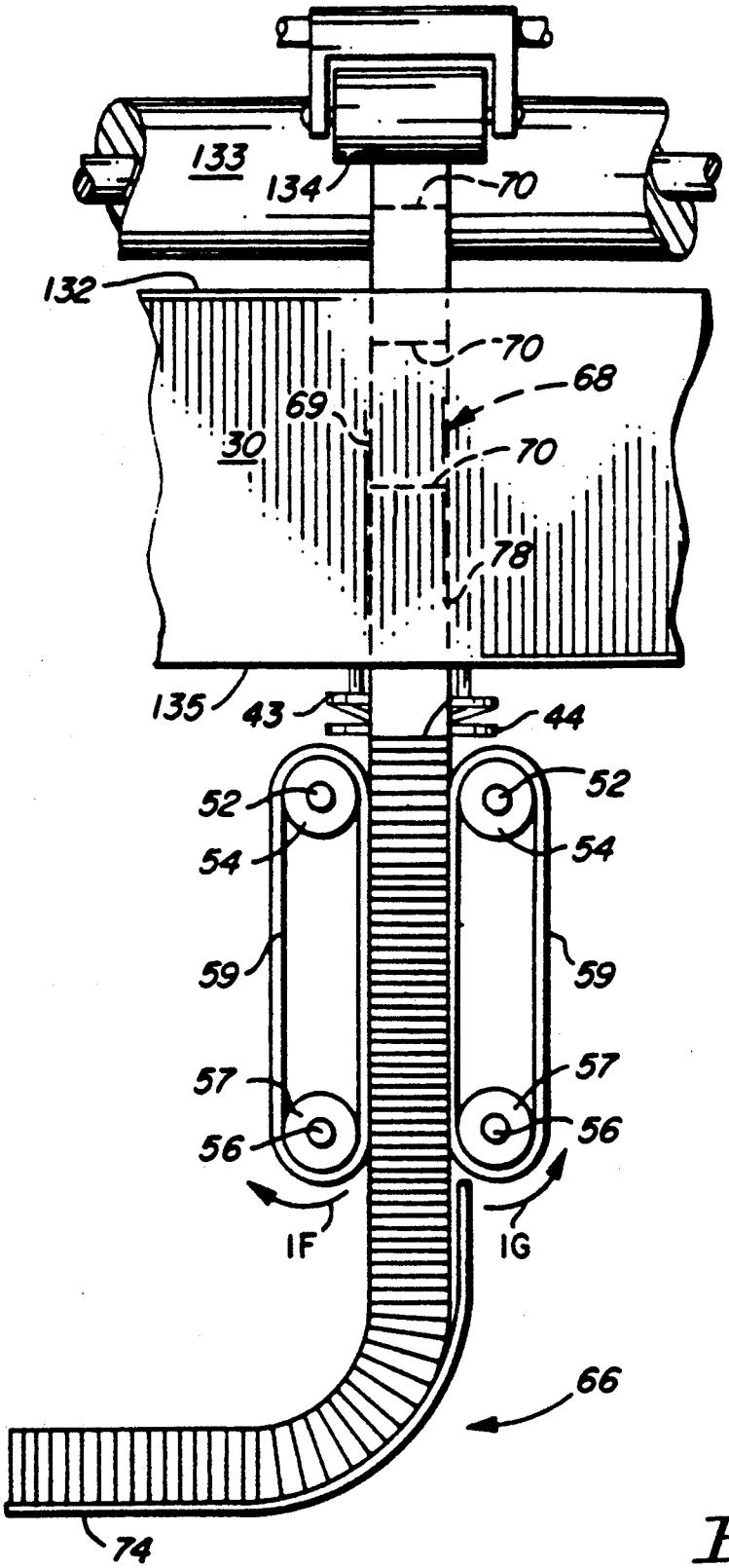

In FIGS. 11 and 12, lines of weakening 70 are alternately distributed in opposite lateral directions of travel by a chute 30. Paper enters chute 30 through elongate opening 132 at the top of chute 30 and exits the chute through mouth 135. Continuous form stationery 68 is directed into chute 30 by feed rollers 133 and 134. Stationery 68 includes elongate parallel opposed spaced apart edges 69, 78. Beaters 80, spirals 43 and 44, and endless belts 59 receive and fold 71 stationery along selected ones of lines of weakening 70. Each endless belt 59 is carried by a spaced apart pair of rollers or sprockets 54 and 57. Each sprocket 54, 57 is fixedly attached to and rotates simultaneously with a shaft 52 or 56. In FIG. 12, the sprockets 54, 57 to the left of the folded stack of paper rotate in a clockwise direction to cause belts 59 carried thereon to move in the direction of arrow 1F. The sprockets 54, 57 to the right of the folded stack of paper rotate in a counterclockwise direction of travel to cause the belts 59 carried thereon to move in the direction indicated by arrow 1G. Means (not shown) are provided for applying motive power to shafts 52 and 56 to rotate the shafts. Similarly, means are provided for powering spirals 43 and 44, beaters 80, chute 30, and feed rollers 133 and 134. The beaters 80, spirals 43 and 44, chute 30 and feed rollers 133 and 134 operate in synchronous relationship. Means for obtaining such synchronous relationship and for driving the various moving components of the apparatus of FIGS. 11 and 12 are well known in the art, as is described herein and in U.S. Pat. No. 4,517,184 to Bunch, Jr. Panel backing 66 receives folded paper downwardly dispensed by moving endless belts 59. When the folded stationery reaches the horizontal landing member 74 of backing 66, the folded stationery is canted and supported on one edge 78. Beaters 80 are omitted from FIG. 12 for the sake of clarity.

As is indicated in FIGS. 11 and 12, there are two sets of belts 59. The first set or unit of spaced apart belts 59 is seen in FIG. 11. Each of the three belts 59 shown in FIG. 11 moves in the direction indicated by arrow 1F in FIG. 12. Each belt 59 in FIG. 11 also moves at the same rate as the other belts in FIG. 11. The belts in FIG. 1 receive and engage edge 69 of folded stationery 68. There is a second set of three spaced apart belts 59 which are not visible in FIG. 11. This second set or unit of belts is spaced away from the first sets of belts 59. The second set of belts receives and engages edge 78 of folded stationery 68. One of the second set of belts 59 is visible in FIG. 12 and comprises the belt 59 moving in the direction of arrow 1G. Each belt in the second set of belts moves in the direction of arrow 1G and moves at the same speed as the other belts 59 in the second set of belts 59. Each belt 59 in the second set of belts is opposed to and spaced apart from a belt 59 in the first set of belts. The distance between each pair of opposed belts 59 (one of the pair being in the first set of belts 59 and the other of the pair being in the second set of belts 59) is equal to the distance between the other pairs of belts 59. Since there are three belts in each of the first set of belts 59 and the second set of belts 59, there are three opposed belt 59 pairs. Each shaft 52 and 56 is parallel to the other remaining shafts 52, 56. Each sprocket 54, 57 has a diameter and size equal to the diameter and size of the other remaining sprockets 54, 57.

Figure 13:
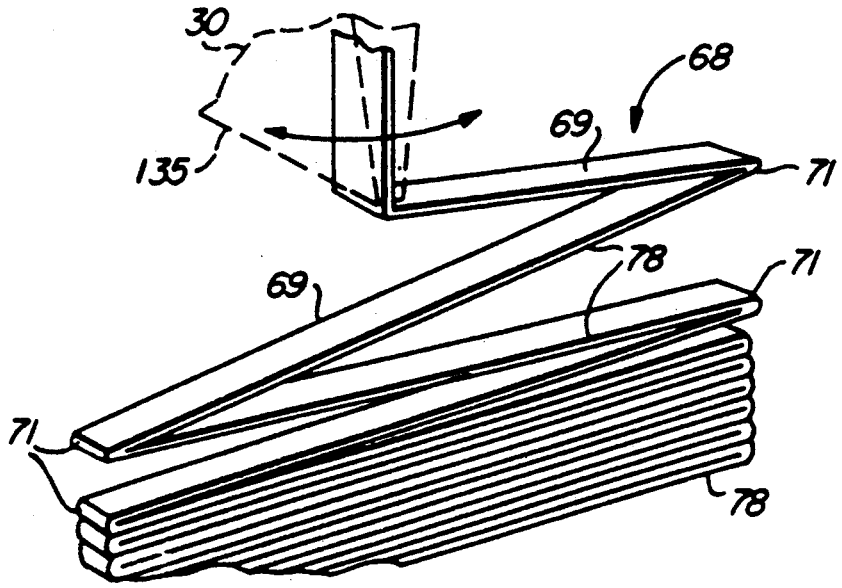

FIG. 13 illustrates the zig-zag distribution of the strip of stationery 68 which is effected by chute 30 and the spirals 43 and 44, beaters 80 and belts 59. The spirals 43 and 44, beaters 80, and belts 59 are omitted from FIG. 13 for the sake of clarity.

Figure 14:
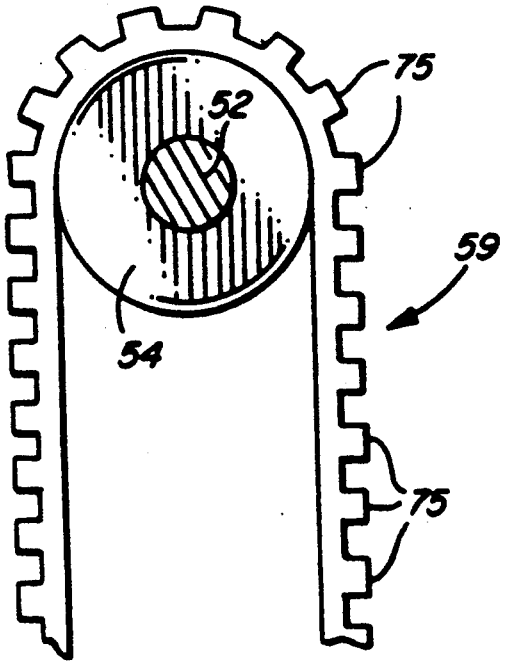

As illustrated in FIG. 14, each belt 59 can include a plurality of parallel, elongate, spaced apart, outwardly extending feet 75. Alternately, a belt 59 can have a smooth outer surface and not include feet 75. If a belt 59 has a smooth outer surface, is it preferred that the belt be resilient or impart a frictional resistance such that the edges 69, 78 engaged by belts 59 will move at the same rate as the belts 59 and will not slide downwardly over the surface of the belts 59.

As would be appreciated by those of skill in the art, the apparatus of FIGS. 11 and 12 can be readily integrated with the cutting mechanism illustrated in FIGS. 8 to 10. Spirals 44 and 43 are replaced with spirals 42C1 and 42D1, respectively, and the base and cutting edge are positioned as indicated by dashed lines 222 and 221 in FIG. 11. In essence, the cutting apparatus of FIG. 8 is (with the exception of sensor 210) positioned adjacent the upper portion of the folds on the left hand side of the stack of folded paper in FIG. 11, and, edge 221 is used to cut stationery 68 along a folded line of perforation 71 while the fold is passing through the spirals 42C1 and 42D1.

Having described my invention in such terms as to enable those skilled in the art to understand and practice it, and having identified the presently preferred embodiments thereof,

I claim:

1. In combination with apparatus for producing continuous form stationery by folding a strip of paper along transverse lines of weakening formed therein, said paper strip including a first side, and a second side opposite and spaced apart from said first side, each of said transverse lines of weakening including
a first end which is nearer to said first side than said second side of said paper strip, and
a second end which is nearer to said second side than said first side of said paper strip,
said apparatus including
a frame,
oscillating guide means mounted on said frame for alternately distributing said successive lines of weakening in said paper strip in substantially opposite directions,
means for feeding said paper strip into said guide means at a predetermined speed,
folding means carrier on said frame and operatively associated with said oscillating guide means for urging said paper distributed by said guide means into a folded condition, said folding means including a first spiral and a second spiral spaced apart from said first spiral, each of said spirals having helical flight means shaped and dimensioned and rotatably driven to receive said paper strip from said oscillating guide means to fold
said paper strip along said transverse lines of weakening, said first spiral being positioned on said first side of said paper strip, said second spiral being positioned on said second side of said paper strip,
said guide means, feeding means and folding means moving in synchronous relationship during the operation of said apparatus,
the improvement comprising means for severing the folded paper along at least a selected one of said folded transverse lines of weakening extending between said first side and said second side of said paper strip and extending between said first and said second spirals, said severing means including
(a) cutting means mounted for transverse movement between at least two operative positions,
(i) a first operative position located on said first side of said paper strip and adjacent said first end of said selected one of said transverse lines of weakening, and
(ii) a second operative position located on said second side of said paper strip and adjacent said second end of said selected one of said transverse lines of weakening; and,
(b) means for moving said cutting means from said first operative position to said second operative position at a selected time to cut said one of said folded transverse lines of weakening, said one of said folded transverse lines of weakening interconnecting paper having a portion extending from said one of said lines of weakening
(i) through and contacting said helical flight means of at least one of said first and second spirals, and
(ii) to a folded line of weakening selected from the group consisting of
the folded line of weakening immediately preceding said one of said folded transverse lines of weakening, and,
the folded line of weakening immediately succeeding said one of said folded transverse lines of weakening,
said immediately preceding and immediately succeeding lines of weakening being folded by said folding means.

2. The apparatus of claim 1 wherein said cutting means includes a cutting blade sloped with respect to said one of said lines of weakening, said blade during said transverse movement between said first and second operative positions,
(a) extending across said transverse line of weakening while moving from said first to said second operative position,
(b) being sloped with respect to said one of said lines of weakening.

3. In combination with apparatus for producing continuous form stationery by folding a strip of paper along transverse lines of weakening formed therein,
said paper strip including
a first side, and
a second side opposite and spaced apart from said first side,
each of said transverse lines of weakening including
a first end which is nearer to said first side than said second side of said paper strip, and
a second end which is nearer to said second side than said first side of said paper strip,
said apparatus including
a frame,
oscillating guide means mounted on said frame for alternately distributing said successive lines of weakening in said paper strip in substantially opposite directions,
means for feeding said paper strip into said guide means at a predetermined speed,
folding means carried on said frame and operatively associated with said oscillating guide means for urging said paper distributed by said guide means into a folded condition, said folding means including a first spiral and a second spiral spaced apart from said first spiral, each of said spirals having helical flight means shaped and dimensioned and rotatably driven to receive said paper strip from said oscillating guide means to fold said paper strip along said transverse lines of weakening, said first spiral being positioned on said first side of said paper strip, said second spiral being positioned on said second side of said paper strip,
said guide means, feeding means and folding means moving in synchronous relationship during the operation of said apparatus,
the improvement comprising means for severing the folded paper along at least a selected one of said folded transverse lines of weakening extending between said first side and said second side of said paper strip and extending between said first and said second spirals, said severing means including
(a) cutting means mounted for transverse movement between at least two operative positions,
(i) a first operative position located on said first side of said paper strip and adjacent said first end of said selected one of said transverse lines of weakening, and
(ii) a second operative position located on said second side of said paper strip and adjacent said second end of said selected one of said transverse lines of weakening;
said cutting means including a cutting blade sloped with respect to said one of said lines of weakening, said blade, during said transverse movement between said first and second operative positions, (iii) extending across said one of said transverse lines of weakening while moving from said first to said second operative position, and (iv) being sloped with respect to said one of said lines of weakening; and, (b) means for moving said cutting means from said first operative position to said second operative position at a selected time to cut said one of said folded transverse lines of weakening.

4. The apparatus of claim 3 wherein said helical flight means of said first spiral is shaped and dimensioned to leave a space between said one of said transverse lines of weakening and said helical flight means of said first spiral when said first spiral is in a selected rotational position to permit the movement of at least a portion of said blade along said one of said lines of weakening through said space intermediate said helical flight means and said one of said lines of weakening.

5. The apparatus of claim 3 wherein said one of said folded lines of weakening interconnects paper having a portion extending from said one of said lines of weakening (a) through and contacting said helical flight means if at least one of said first and second spirals, and (b) to a folded line of weakening selected from the group consisting of the folded line of weakening immediately preceding said one of said folded transverse lines of weakening, and, the folded line of weakening immediately succeeding said one of said folded transverse lines of weakening, said immediately preceding and immediately succeeding lines of weakening being folded by said folding means.

6. In combination with apparatus for producing continuous form stationery by folding a strip of paper along transverse lines of weakening formed therein, said paper strip including a first side, and a second side opposite and spaced apart from said first side, each of said transverse lines of weakening including a first end which is nearer to said first side than said second side of said paper strip, and a second end which is nearer to said second side than said first side of said paper strip, said apparatus including a frame, oscillating guide means mounted on said frame for alternately distributing said successive lines of weakening in said paper strip in substantially opposite direction, means for feeding said paper strip into said guide means at a predetermined speed, folding means carried on said frame and operatively associated with said oscillating guide means for urging said paper distributed by said guide means into a folded condition, said folding means including a first spiral and a second spiral spaced apart from said first spiral, each of said spirals having helical flight means shaped and dimensioned and rotatably driven to receive said paper strip from said oscillating guide means to fold said paper strip along said transverse lines of weakening, said first spiral being positioned on said first side of said paper strip, said second spiral being positioned on said second side of said paper strip, said guide means, feeding means and folding means moving in synchronous relationship during the operation of said apparatus, the improvement comprising means for severing the folded paper along at least a selected one of said folded transverse lines of weakening extending between said first side and said second side of said paper strip and extending between said first and said second spirals, said severing means including (a) cutting means mounted for transverse movement between at least two operative positions, (i) a first operative position located on said first side of said paper strip and adjacent said first end of said selected one of said transverse lines of weakening, and (ii) a second operative position located on said second side of said paper strip and adjacent said second end of said selected one of said transverse lines of weakening; and, (b) means for moving said cutting means from said first operative position to said second operative position at a selected time to cut said one of said folded transverse lines of weakening, said helical flight means of said first spiral being shaped and dimensioned to leave a space between said one of said transverse lines of weakening and said helical flight means of said first spiral when said spiral is in a selected rotational position to permit the movement of at least a portion of said cutting means along said one of said line of weakening through said space intermediate said helical spiral means and said one of said lines of weakening.

7. The apparatus of claim 6 wherein said one of said folded lines of weakening interconnects paper having a portion extending from said one of said lines of weakening (a) through and contacting said helical flight means of at least one of said first and second spirals, and (b) to a folded line of weakening selected from the group consisting of the folded line of weakening immediately preceding said one of said folded transverse lines of weakening, and, the folded line of weakening immediately succeeding said one of said folded transverse lines of weakening, said immediately preceding and immediately succeeding lines of weakening being folded by said folding means.

* * * * *